US008439113B2

(12) United States Patent
Boyle

(10) Patent No.: US 8,439,113 B2
(45) Date of Patent: May 14, 2013

(54) PUMP IN REVERSE OUTLINER DRILLING SYSTEM

(75) Inventor: John Boyle, The Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 323 days.

(21) Appl. No.: 12/776,024

(22) Filed: May 7, 2010

(65) Prior Publication Data

US 2010/0282463 A1 Nov. 11, 2010

Related U.S. Application Data

(60) Provisional application No. 61/176,779, filed on May 8, 2009.

(51) Int. Cl.
*E21B 33/14* (2006.01)

(52) U.S. Cl.
USPC ..... 166/285; 175/171

(58) Field of Classification Search ..... 166/277, 166/285, 382; 175/171
See application file for complete search history.

(56) References Cited

U.S. PATENT DOCUMENTS

| | | | |
|---|---|---|---|
| 3,163,238 | A | 12/1964 | Malott |
| 5,074,366 | A | 12/1991 | Karlsson et al. |
| 5,425,423 | A | 6/1995 | Dobson et al. |
| 5,957,225 | A | 9/1999 | Sinor |
| 6,095,261 | A | 8/2000 | Trevino, Jr. |
| 6,138,774 | A | 10/2000 | Bourgoyne, Jr. et al. |
| 6,412,574 | B1 | 7/2002 | Wardley et al. |
| 6,543,552 | B1 | 4/2003 | Metcalfe et al. |
| 6,742,606 | B2 | 6/2004 | Metcalfe et al. |
| 6,854,533 | B2 | 2/2005 | Galloway et al. |
| 6,857,487 | B2 | 2/2005 | Galloway et al. |
| 6,899,186 | B2 | 5/2005 | Galloway et al. |
| 7,013,997 | B2 | 3/2006 | Vail, III |

(Continued)

FOREIGN PATENT DOCUMENTS

| | | |
|---|---|---|
| CA | 2538196 | 8/2006 |
| WO | WO2007/011906 A1 | 1/2007 |

OTHER PUBLICATIONS

Weatherford "R Running Tool with Hydraulically Released Mechanical Lock", 2006, pp. 1-2.

(Continued)

*Primary Examiner* — Brad Harcourt
(74) *Attorney, Agent, or Firm* — Osha • Liang LLP

(57) ABSTRACT

A liner string for a well has a liner hanger assembly at an upper portion of the liner string. A profile sub is located at a bottom portion of the liner string. A bottom hole assembly is latched to the profile sub. The operator lowers the liner string into the well with a drill pipe string and rotates the drill pipe string to rotate the drill bit to deepen the well. At a selected depth, the operator releases the bottom hole assembly from the profile sub and reverse circulates drilling fluid from a liner annulus surrounding the liner string, pumping the bottom hole assembly up the liner string. When the bottom hole assembly reaches the lower end of the drill pipe string, it latches to a catcher tool located at the lower end of the drill pipe string. The operator moves the liner hanger assembly into setting engagement with the casing string, releases the drill pipe string from the liner string, and retrieves the drill pipe string along with the bottom hole assembly.

18 Claims, 2 Drawing Sheets

U.S. PATENT DOCUMENTS

| | | | | |
|---|---|---|---|---|
| 7,036,610 | B1 | 5/2006 | Vail, III | |
| 7,040,420 | B2 | 5/2006 | Vail, III | |
| 7,044,241 | B2 | 5/2006 | Angman | |
| 7,048,050 | B2 | 5/2006 | Vail, III et al. | |
| 7,083,005 | B2 | 8/2006 | Galloway et al. | |
| 7,093,675 | B2 | 8/2006 | Pia | |
| 7,100,710 | B2 | 9/2006 | Vail, III | |
| 7,108,080 | B2 | 9/2006 | Tessari et al. | |
| 7,108,084 | B2 | 9/2006 | Vail, III | |
| 7,117,957 | B2 | 10/2006 | Metcalfe et al. | |
| 7,147,068 | B2 | 12/2006 | Vail, III | |
| 7,165,634 | B2 | 1/2007 | Vail, III | |
| 7,228,901 | B2 | 6/2007 | Vail, III | |
| 7,234,542 | B2 | 6/2007 | Vail, III | |
| 7,311,148 | B2 | 12/2007 | Giroux et al. | |
| 7,334,650 | B2 | 2/2008 | Giroux et al. | |
| 7,604,057 | B1 | 10/2009 | Eriksen et al. | |
| 7,647,990 | B2 | 1/2010 | Tessari et al. | |
| 2001/0017210 | A1 | 8/2001 | Howlett | |
| 2005/0103525 | A1 | 5/2005 | Sangesland | |
| 2006/0196695 | A1 | 9/2006 | Giroux et al. | |
| 2007/0007014 | A1 | 1/2007 | Sessions et al. | |
| 2007/0051538 | A1* | 3/2007 | Angman et al. | 175/57 |
| 2007/0175665 | A1 | 8/2007 | Tessari et al. | |
| 2007/0267221 | A1 | 11/2007 | Giroux et al. | |
| 2009/0090508 | A1 | 4/2009 | Brouse | |
| 2009/0101345 | A1 | 4/2009 | Moffitt et al. | |
| 2009/0107675 | A1 | 4/2009 | Eriksen et al. | |

OTHER PUBLICATIONS

Drilling Contractor "Liner Drilling Technology Being Prepared for Offshore", Jan./Feb. 2004, pp. 14-15.
Dril-Quip LS-15 Liner Hanger System, Sales Manual, pp. 5-7.
TIW "Liner Equipment" HLX Liner-Top Packer, pp. 5, 9-11, 18-19.
Dril-Quip "LS-15 Liner Hanger System", pp. 1-2, 4 and 6.
U.S. Appl. No. 12/275,396, filed Nov. 21, 2008.
U.S. Appl. No. 12/238,191, filed Sep. 25, 2008.
World Oil/Oct. 1999—Drilling Technology "Casing-While-Drilling: The Next Step Change in Well Construction", pp. 34-36 and 38-40.
Rotary Steerable Drilling with Liner—during 2007 or later based on the text—Randi Elisabeth Hugdahl, Leader, TNE RD RCT DWPT—pp. 3-5.
Drilling Liner Technology for Depleted Reservoir, C. Vogt, SPE and F. Makohl, SPE, Baker Hughes INTEQ; P. Suwarno, SPE and B. Quitzau, SPE, Mobil Oil Indonesia—SPE 36827—pp. 127-132.
Simultaneous Drill and Case Technology—Case Histories, Status and Options for Further Development, by Detlef Hahn, Baker Hughes Inteq, Wilhelmus Van Gestel, BP Amoco Norway AS, Norbert Frohlich, Baker Hughes Inteq., Glenn Stewart, Baker Hughes Inteq—SPE International, IADC/SPE 59126, Feb. 23-25, 2000, pp. 1-9.
U.S. Appl. No. 12/347,443, filed Dec. 31, 2008.
U.S. Appl. No. 12/347,610, filed Dec. 31, 2008.

* cited by examiner

PUMP IN REVERSE OUTLINER DRILLING SYSTEM

CROSS-REFERENCE TO RELATED APPLICATION

This application claims priority to provisional patent application 61/176,779, filed May 8, 2009.

FIELD OF THE INVENTION

This invention relates in general to drilling a well with a liner, and in particular to retrieving a bottom hole assembly prior to reaching the intended depth for the liner.

BACKGROUND OF THE INVENTION

Oil and gas wells are conventionally drilled with drill pipe to a certain depth, then casing is run and cemented in the well. The operator may then drill the well to a greater depth with drill pipe and cement another string of casing. In this type of system, each string of casing extends to the surface wellhead assembly.

In some well completions, an operator may install a liner rather than another string of casing. The liner is made up of joints of pipe in the same manner as casing. Also, the liner is normally cemented into the well. However, the liner does not extend back to the wellhead assembly at the surface. Instead, it is secured by a liner hanger to the last string of casing just above the lower end of the casing. The operator may later install a tieback string of casing that extends from the wellhead downward into engagement with the liner hanger assembly.

When installing a liner, in most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner hanger and pumps cement through the drill pipe, down the liner and back up an annulus surrounding the liner. The cement shoe prevents backflow of cement back into the liner. The running tool may dispense a wiper plug following the cement to wipe cement from the interior of the liner at the conclusion of the cement pumping. The operator then sets the liner top packer, if used, releases the running tool from the liner hanger, and retrieves the drill pipe.

A variety of designs exist for liner hangers. Some may be set in response to mechanical movement or manipulation of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads, shear elements, or by a hydraulically actuated arrangement.

In another method of installing a liner, the operator runs the liner while simultaneously drilling the wellbore. A drill bit is located at the lower end of the liner. This method is similar to a related technology known as casing drilling. One option is to not retrieve the drill bit, rather cement it in place with the liner. If the well is to be drilled deeper, the drill bit would have to be a drillable type. This technique does not allow one to employ components that must be retrieved, which might include downhole steering tools, measuring while drilling instruments and retrievable drill bits. Retrievable bottom hole assemblies are known for casing drilling, but in casing drilling, the upper end of the casing is at the rig floor. In typical liner drilling, the upper end of the liner is deep within the well and the liner is suspended on a string of drill pipe. In casing drilling, the bottom hole assembly can be retrieved and rerun by wire line, drill pipe, or by pumping the bottom hole assembly down and back up. With liner drilling, the drill pipe that suspends the liner is much smaller in diameter than the liner and has no room for a bottom hole assembly to be retrieved through it. Being unable to retrieve the bit for replacement thus limits the length that can be drilled and thus the length of the liner. If unable to retrieve and rerun the bottom hole assembly, the operator would not be able to liner drill with expensive directional steering tools, logging instruments and the like, without planning for removing the entire liner string to retrieve the tools.

If the operator wishes to retrieve the bottom hole assembly before cementing the liner, there are no established methods and equipment for doing so. Also, if the operator wishes to rerun the bottom hole assembly and continue drilling with the liner, there are no established methods and equipment for doing so. Some liner drilling proposals involve connecting a bottom hole assembly to a string of drill pipe and running the drill pipe to the bottom of the liner. Retrieving the drill string at the conclusion of the drilling would retrieve the bottom hole assembly.

It is known in the patented art to retrieve a bottom hole assembly by reverse circulation. The operator causes drilling fluid in the annulus surrounding the casing to flow downward into the lower end of the casing string and back up the casing string. The reverse circulation exerts an upward force on the bottom hole assembly that will move the bottom hole assembly upward. Various concepts are known for causing the bottom hole assembly to return to the rig floor.

SUMMARY

As disclosed herein, the operator installs a profile sub at a bottom portion of a liner string being made up and latches a bottom hole assembly to the profile sub. The bottom hole assembly includes a drill bit. The operator secures a liner hanger assembly to an upper portion of the liner string. Once the liner string is made up, the operator secures a lower end of a drill pipe string to an upper portion of the liner string and lowers the liner string on the drill pipe string until the drill bit reaches a bottom of the well. The drill bit may then be rotated to drill the well deeper;

At a selected depth, the operator releases the bottom hole assembly from the profile sub and reverse circulates drilling fluid from a liner annulus surrounding the liner string. The reverser circulation pumps the bottom hole assembly up the liner string. When the bottom hole assembly reaches the lower end of the drill pipe string, the operator latches the bottom hole assembly to a catcher tool located at the lower end of the drill pipe string. The operator moves the liner hanger assembly into setting engagement with the casing string to support the weight of the liner string. Then the drill pipe string may be released from the liner string and retrieved along with the bottom hole assembly.

If not at total depth, the operator may re-run the drill pipe string and the bottom hole assembly back into the casing string and re-securing the lower end of the drill pipe string to the upper portion of the liner string. The operator releases the liner hanger assembly from setting engagement with the casing string and releases the bottom hole assembly from the lower end of the drill pipe string. The operator pumps fluid down the drill pipe string to move the bottom hole assembly down the liner string latch into the profile sub. Drilling my then continue.

When at total depth, the operator retrieves the bottom hole assembly as before. The operator detaches the catcher tool from the lower end of the drill pipe string and attaches a cementing tool, which is lowered by the drill pipe string into the casing string. When at the appropriate depth, the operator secures the cementing tool to the liner hanger assembly and pumps cement through the drill pipe string and the cementing tool into the liner string and back up the annulus to cement the liner string in the well. Preferably the cement tool carries one or more cement plug devices. The operator launches the cement plug device from the cementing tool, which latches into the bottom portion of the liner string and prevents backflow of cement from the annulus into the liner string.

BRIEF DESCRIPTION AND DRAWINGS

DETAILED DESCRIPTION

Figure 1:
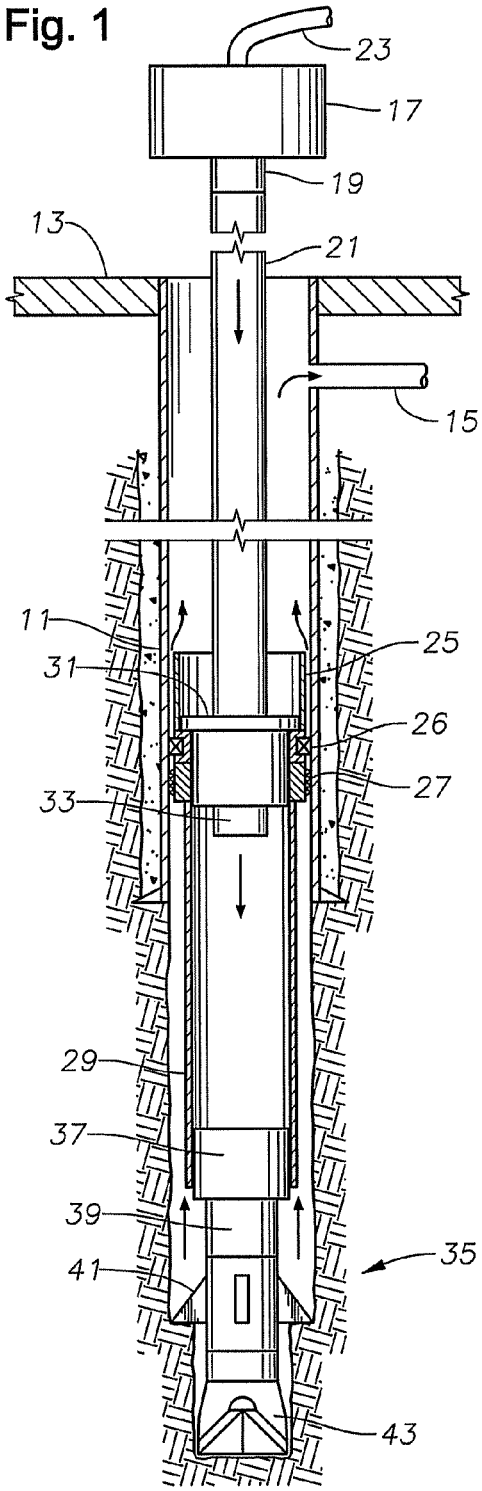
FIG. 1 is a side elevational view, partially sectioned, of a liner drilling system in the process of drilling.

Referring to FIG. 1, one or more strings of casing 11 have been previously installed in the well. The upper end of casing 11 is at the wellhead. In the case of a land drilling rig, the wellhead for casing 11 will be a short distance below rig floor 13 of the drilling rig. In the case of a subsea well, casing 11 will extend to a subsea wellhead housing at the sea floor, and a riser connects the subsea wellhead housing to the drilling platform on the surface of the water. A drilling fluid circulation system has a drilling fluid return 15 at the drilling rig for returning drilling fluid and removing cuttings.

The drilling rig may have a top drive 17, which will move upward and downward along one or more vertical rails attached to the derrick. Top drive 17 comprises an electrical or hydraulic motor that rotates a quill 19. A string of conventional drill pipe 21 secures to quill 19 for rotation and axial movement therewith. Drill pipe 21 is made up of separate segments or joints that are secured together by threads. The inner diameter of drill pipe 21 is normally much smaller than the inner diameters of any casing 11 or other pipe strings cemented within the well. Drill pipe 21 is meant to be used over and over and not cemented within a well. A mud hose 23 mounts to top drive 17 for delivering drilling fluid pumped by the drilling rig pump into the interior of drill pipe 21.

A liner tieback sleeve 25 and a packer 26 are secured to a liner hanger 27, which in turn is connected to a string of liner 29. Liner 29 comprises joints of casing that are secured together by threads. Liner 29 is intended to be cemented into the well when the total depth for liner 29 is reached, and normally has an inner diameter much greater than the inner diameter of drill pipe 21. Liner 29 differs from casing 11 in that its upper end will not extend all the way to the surface or top of the well when cemented in place. Instead, the upper end of liner 29 will be a short distance above the lower end of casing 11. Liner hanger 27 is a device that, when actuated, grips the inner diameter of casing 11 to support the weight of liner 29. Preferably, liner hanger 27 can be released and reset repeatedly. Resettable liner hangers are shown and described in US 2009/0107675 and US 2009/0090508, all of which material is hereby incorporated by reference. Packer 26, which is actuated after liner 29 has been cemented in place, will seal the outer diameter of liner tieback sleeve 25 to the inner diameter of casing 11.

A running tool 31 is secured to the lower end of drill pipe 21. Running tool 31 releasably engages liner tieback sleeve 25 and liner hanger 27. Running tool 31 may be released from liner tieback sleeve 25 and liner hanger 27 in a variety of matter. One technique involves dropping a seat element such as a dart or ball. Another method involves manipulating running tool 31, such as by left-hand rotation, relative to liner tieback sleeve 25. Running tool 31 will support the weight of the string of liner 29, and transfers that weight to drill pipe 21. Running tool 31 also forms a seal with the interior of liner tieback sleeve 25.

A launch and catch tool 33 is located on the lower end of running tool 31. Launch and catch tool 33 is configured to mate with a bottom hole assembly ("BHA") 35, which is shown in FIG. 1 at the lower end of liner 29. BHA 35 includes a latch assembly 37 that will releasably latch to a collar or profile sub connected into the string of liner 29 near the lower end. Latch assembly 37 may be released from the profile sub by pumping a release member into the upper end of drill pipe 21, which moves downward through drill pipe 21 and into engagement with a seat provided in latch assembly 37. Once landed, applying drilling fluid pressure from drill pipe 21 will cause the release member to release latch assembly 37 to allow its retrieval. Latch assembly 37 and/or the release member has seals on its outer diameter that seal to the inner diameter of liner 29. The seals enable BHA 35 to be pumped upward within liner hanger 27 after latch assembly 37 is released from the profile sub in liner 29.

Launch and catch tool 33 has a latch or grapple on its lower end that BHA 35 will engage when BHA 35 has been pumped to the upper end of liner 29. Once engaged, launch and catch tool 33 will support the weight of BHA 35, which may be 30,000 pounds or more. Launch and catch tool 33 also has a release mechanism that will release or launch BHA 35 when actuated. Once released, BHA 35 may be pumped or transported by gravity back downward in liner 29. The releasing of BHA 35 from launch and catch tool 33 may be performed by pumping a seating or release element down drill pipe 21, which slides a release mechanism in launch and catch tool 33 when landing and drilling fluid pressure is applied.

BHA 35 may include a spacer pipe 39 that positions an underreamer 41 and drill bit 43 a selected distance below the lower end of liner 29. Underreamer 41 will enlarge the well bore formed by drill bit 43 to a diameter greater than the outer diameter of liner 29. The arms of underreamer 41 will collapse to allow it to be transported within liner 29. BHA 35 may additionally include other components, such as a mud motor for rotating underreamer 41 and drill bit 43 relative to liner 29. It may also include logging tools for measuring the formation and steering tools for steering drill bit 43 in a desired direction in an inclined well. Latch assembly 37 locks BHA 35 both axially as well rotationally to liner 29 so as to transmit torque imposed on liner 29 to BHA 35.

In operation, normally the operator would install BHA 35 while liner 29 is being made up and suspended at rig floor 13. The operator then connects additional joints of liner 29 to lengthen liner 29 to a desired length. When at the desired length, the operator attaches liner tieback sleeve 25, packer 26 and liner hanger 27 to the upper end of liner 29. The operator secures liner running tool 31 to drill pipe 21 and attaches liner running tool 31 to liner tieback sleeve 25 and liner hanger 27. The operator then adds additional joints to the string of drill pipe 21 to lower the assembly of liner 29 and BHA 35 into casing 11.

When drill bit 43 reaches the bottom of the borehole, typically at the lower end of casing 11, the operator rotates drill pipe 21 with top drive 17 and pumps drilling fluid through hose 23 down drill pipe 21. In this position, which is shown in FIG. 1, the rotation of drill pipe 21 will transmit drilling torque from running tool 31 to liner 29. The drilling torque will be transmitted down liner 29 and from liner 29 to latch assembly 37 and to BHA 35. The drilling fluid exits the lower end of launch and catch tool 33, flows down liner 29 through BHA 35 and back up an annulus surrounding BHA 35 and liner 29, as shown in FIG. 1. The drilling fluid will exit drilling fluid return 15 for removal of cuttings and reinjection.

The operator may wish to retrieve BHA 35 before liner 29 reaches its total depth. For example, drill bit 43 may need to be replaced, or there may be a malfunction in the surveying and steering units. To retrieve, the operator will release latch assembly 37 from the profile sub within liner 29, and this may be done by dropping a release member, which is pumped downward through drill pipe 21, running tool 31 and into latch assembly 37. The pump pressure in drill pipe 21 applied to the release member will cause latch assembly 37 to release. The operator then begins to reverse circulate.

Figure 2:
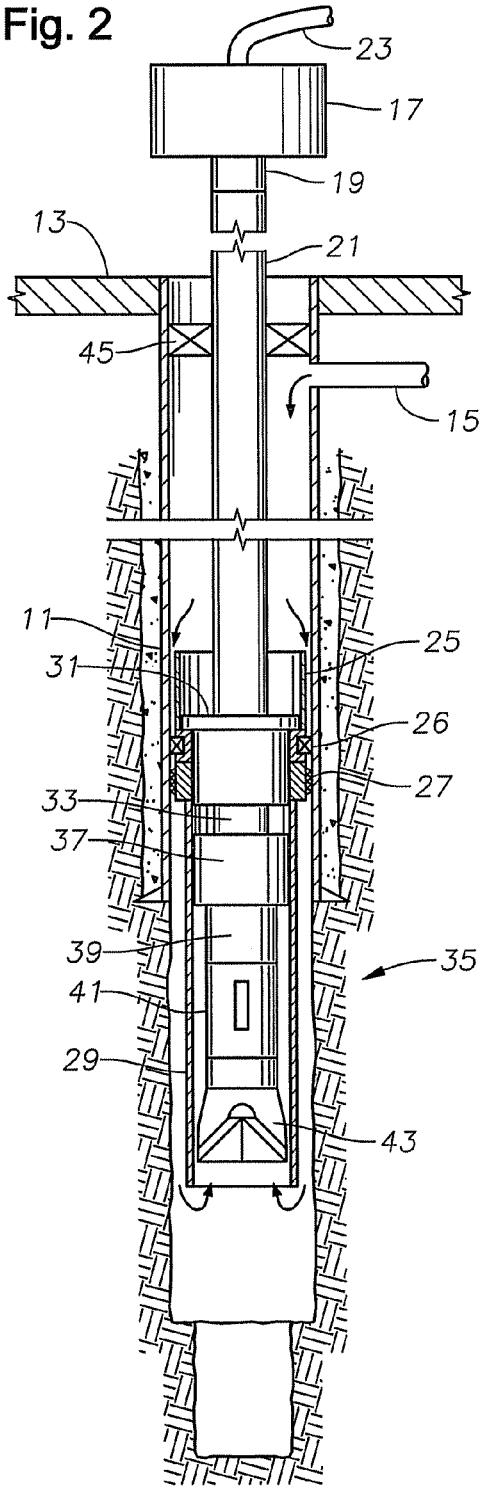
FIG. 2 is a sectional view similar to FIG. 1, but showing the bottom hole assembly moving up the liner into engagement with the running tool on the end of the drill pipe.

As shown in FIG. 2, this may be accomplished in one method by sealing around drill pipe 21, such as with a blowout preventer or drill pipe rams 45. The operator pumps drilling mud into drill fluid return 15, which creates flow down the annulus surrounding drill pipe 21. Because running tool 31 has a seal between its outer diameter and the inner diameter of liner tieback sleeve 25, the drilling fluid does not flow into the interior of liner 29. Instead, the drilling fluid pressure acts down the annulus surrounding liner 29 and up against the seal located on latch assembly 37, the release member or another part of BHA 35. This fluid pressure causes the BHA 35 to move upward relative to liner 29.

Another method of creating reverse circulation would be to pump a selected quantity of fluid lighter than the drilling mud, such as water, down drill pipe 21. The less dense fluid would force the heavier drilling mud in liner 29 downward through BHA 35 and up into the annulus surrounding BHA 35 and liner 29. The quantity of less dense fluid pumped in would preferably be an amount sufficient to displace all of the drilling mud from the interior of liner 29, but not much from the annulus surrounding liner 29. When pumping of the less dense fluid stops, the heavier drilling mud in the annulus than in the interior of liner 29 exerts a net upward force on the seals on latch assembly 37, pushing BHA 35 upward. This occurs as a result of the U-tubing effect of the heavier fluid exerting more upward force on the seal on latch assembly 37 than the downward force due to the less dense fluid in liner 29. The operator would pump drilling mud through drilling fluid return 15 into the annulus to maintain it full, but the pressure on the column of drilling mud in the annulus at the surface could remain at atmospheric.

As BHA 35 moves upward and more drilling mud flows into liner 29 below BHA 35, the upward force lessens. Preferably BHA 35 has a slip arrangement that prevents it from sliding back down liner 29 in the event the upward force becomes insufficient to continue the upward movement of BHA 35. The operator would then again pump a quantity of less dense fluid down drill pipe 21 into liner 29 and through BHA 35 so as to place a quantity of less dense fluid below BHA 35. When the quantity is dispensed, U-tubing would again create a net upward force on the seal on latch assembly 37, propelling BHA 35 upward.

Figure 3:
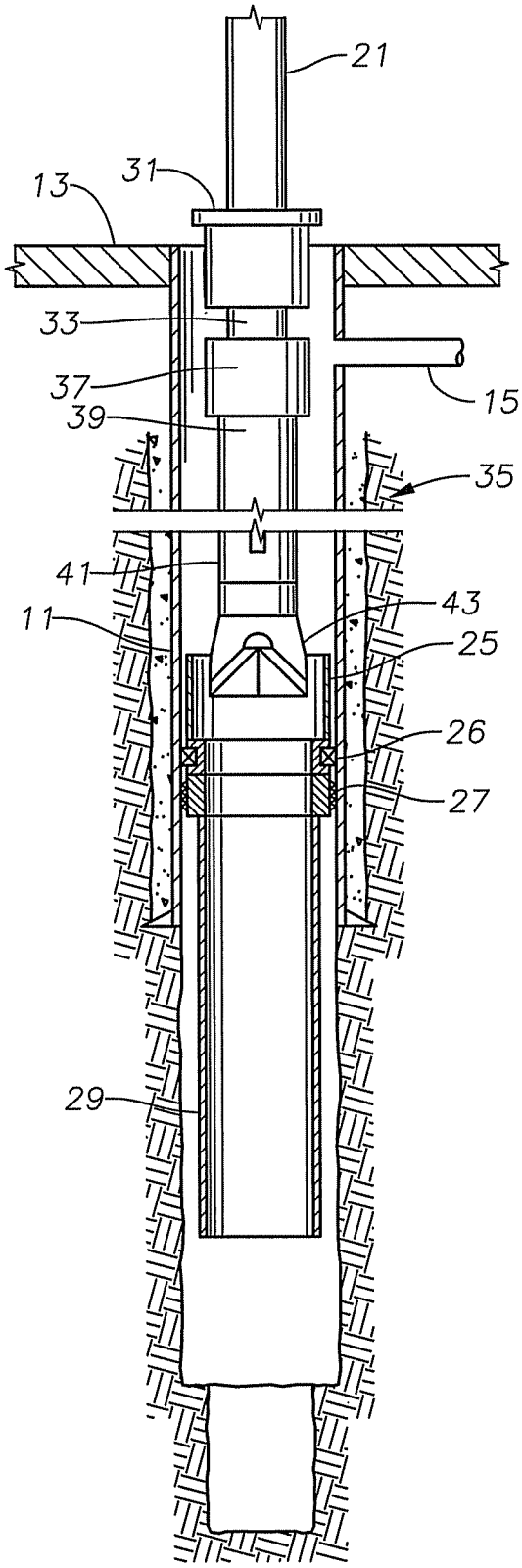
FIG. 3 is a view similar to FIG. 2, but showing the drill pipe being retrieved from the liner string along with the bottom hole assembly.

As shown in FIG. 2, latch assembly 37 will latch into engagement with the grapple on launch and catch tool 33. Once in engagement, the reverse circulation may stop. The operator then sets liner hanger 27 in casing 11 and releases running tool 31 from liner tieback sleeve 25. That, too, may be done by dropping a ball or dart, but of a larger diameter then the release member used to release latch assembly 37 from the profile sub in liner 29. That seating object will cause running tool 31 to set liner hanger 27 so that it grips the inner diameter of casing 11 and supports the weight of liner 29. Running tool 31 releases from liner tieback sleeve 25, which allows the operator to retrieve drill pipe 21, bringing BHA 35 along with it, as shown in FIG. 3. Liner 29 remains suspended by the engagement of liner hanger 27 with casing 11. The operator replaces various components of BHA 35 at the surface, reattaches BHA 35 to launch and catch tool 33, then reruns the assembly on drill pipe 21.

First, running tool 31 will engage liner tieback sleeve 25 and liner hanger 27. Running tool 31 is then manipulated, such as by rotation, to cause it to reengage with liner tieback sleeve 25 and release liner hanger 27 from its engagement with casing 11. At that point, drill pipe 21 will be supporting liner 29 and BHA 35 will still be attached to launch and catch tool 33.

The operator then launches BHA 35, which may be done by dropping a seating object, such as a ball or dart. Latch assembly 37 will release from launch and catch tool 33. The operator pumps drilling fluid down drill pipe 21, which acts against the seal on latch assembly 37, pumping BHA 35 to the bottom of liner 29. When latch assembly 37 reaches the profile sub within liner 29, it will latch itself to the profile sub, both rotationally as well as axially. The operator may now continue drilling. It is possible that this retrieval process may need to be repeated before reaching total depth.

When at the total depth, the operators will repeat the procedure for retrieving the BHA 35. The operator would attach a cementing tool (not shown) to drill pipe 21, rather than BHA 35, and rerun drill pipe 21. The cementing tool will have a launch mechanism for launching a cement wiper plug and preferably a cement receptacle or valve. Cementing tools are shown and described in U.S. patent application Ser. No. 12/347,443 filed Dec. 31, 2008 and US 2009/0101345, all of which material is hereby incorporated by reference. The cement tool engages liner tieback sleeve 25, but does not release liner hanger 27 from its gripping engagement with casing 11. The operator may then pump down a cement valve or plug receptacle (not shown) down through liner 29, which latches to a lower end of liner 29. The cement valve or plug receptacle may be launched by pumping a seating object such as a ball or dart down drill pipe 21. The operator pumps cement down liner 29 and back up the annulus surrounding liner 29. The operator launches a wiper plug following the cement, which cleans the liner of cement. The cement valve or plug receptacle after engagement by a wiper plug, prevents cement in the annulus from flowing back up into liner 29. The operator then sets packer 26, releases the cement tool from liner tieback sleeve 25 and retrieves drill pipe 21.

The method may also be employed with a liner hanger that is not resettable. In that instance, to retrieve BHA 35, the operator may pull liner tieback sleeve 25 to rig floor 13, then initiate reverse circulation while running tool 31 is still attached to liner 29. Alternately, the operator could pull the upper end of liner 29 up to blowout preventer 45, and cause blowout preventer 45 to engage and suspend the weight of the string of liner. For example, if drilling an offshore well through a subsea wellhead housing, blowout preventer 45 may be subsea and attached to the subsea wellhead housing. Liner 29 would then be pulled only up to the blowout preventer, which is near the sea floor rather than all the way up to rig floor 13. While running tool 31 is still connected to liner 29, the operator would initiate reverse circulation in one of the manners described above to cause the retrieval of BHA 35 up to the top of liner 29. A non-resettable liner hanger might be particularly an alternative when the length of liner 29 is not very long and it is not expected to have to retrieve BHA 35 before reaching total depth.

While the invention has been shown in only one of its forms, it should be apparent to those skilled in the art that it is not so limited but is susceptible to various changes without departing from the scope of the invention.

The invention claimed is:

1. A method of installing a liner in a well having at least one casing string, comprising:

(a) making up a liner string with a liner hanger assembly at an upper portion of the liner string, a profile sub at a bottom portion of the liner string, and a bottom hole assembly latched to the profile sub, the bottom hole assembly including a drill bit;

(b) securing a lower end of a drill pipe string to an upper portion of the liner string and lowering the liner string on the drill pipe string until the drill bit reaches a bottom of the well, then rotating the drill bit to drill the well deeper;

(c) at a selected depth, releasing the bottom hole assembly from the profile sub and reverse circulating drilling fluid from a liner annulus surrounding the liner string, thereby pumping the bottom hole assembly up the liner string;

(d) when the bottom hole assembly reaches the lower end of the drill pipe string, latching the bottom hole assembly to a catcher tool located at the lower end of the drill pipe string;

(e) moving the liner hanger assembly into setting engagement with the casing string to support the weight of the liner string; and (f) releasing the drill pipe string from the liner string and retrieving the drill pipe string along with the bottom hole assembly;

detaching the catcher tool from the lower end of the drill pipe string and attaching a cementing tool to the drill pipe string, re-running the drill pipe string back into the casing, and securing the cementing tool to the liner hanger assembly; then pumping cement through the drill pipe string and the cementing tool into the liner string and back up the annulus to cement the liner string in the well.

2. The method according to claim 1, further comprising:

after step (f), re-running the drill pipe string and the bottom hole assembly back into the casing string and re-securing the lower end of the drill pipe string to the upper portion of the liner string;

releasing the liner hanger assembly from setting engagement with the casing string;

releasing the bottom hole assembly from the lower end of the drill pipe string;

pumping fluid down the drill pipe string to move the bottom hole assembly down the liner string latch into the profile sub; then rotating the drill bit and continuing to deepen the well.

3. The method according to claim 1, wherein the cementing tool is carrying a cement plug device;

the method further comprising: launching the cement plug device from the cementing tool, which latches into the bottom portion of the liner string and prevents backflow of cement from the annulus into the liner string.

4. The method according to claim 3, further comprising:

after cementing and before retrieving the drill pipe string and the cementing tool, setting a packer between the upper portion of the liner string and the casing string.

5. The method according to claim 1, wherein in step (a) the bottom hole assembly is latched to the profile sub before attaching the liner hanger assembly.

6. The method according to claim 1, wherein step (b) comprises rotating the drill pipe string, transferring torque from the drill pipe string to the upper portion of the liner string to cause the liner string to rotate, and transferring torque from the lower portion of the liner string to the bottom hole assembly to rotate the drill bit.

7. A method of installing a liner in a well having at least one casing string, comprising:

(a) making up a liner string with a resettable liner hanger assembly at an upper portion of the liner string, a profile sub at a bottom portion of the liner string, and a bottom hole assembly latched to the profile sub, the bottom hole assembly including a drill bit;

(b) securing a lower end of a drill pipe string to the upper portion of the liner string and lowering the liner string on the drill pipe string until the drill bit reaches a bottom of the well, then rotating the drill bit to deepen the well;

(c) if repair or replacement of the bottom hole assembly is desired before reaching total depth, releasing the bottom hole assembly from the profile sub and reverse circulating drilling fluid from a liner annulus surrounding the liner string, thereby pumping the bottom hole assembly up the liner string;

(d) when the bottom hole assembly reaches the lower end of the drill pipe string, latching the bottom hole assembly to a catcher tool located at the lower end of the drill pipe string;

(e)moving the liner hanger assembly into setting engagement with the casing string to support the weight of the liner string;

(f)releasing the drill pipe string from the liner string and retrieving the drill pipe string along with the bottom hole assembly;

(g)re-running a repaired or replaced bottom hole assembly on the drill pipe string and re-securing the lower end of the drill pipe string to the upper portion of the liner string;

(h)releasing the liner hanger assembly from setting engagement with the casing string; (i) releasing the bottom hole assembly from the lower end of the drill pipe string and applying fluid pressure to the drill pipe string, thereby pumping the repaired or replaced bottom hole assembly down the liner string into latching engagement with the profile sub; then (j) rotating the drill bit to deepen the well;

when reaching a selected depth in step (j), repeating steps (c) through (f), then detaching the catcher tool from the drill pipe string and attaching a cementing tool to the drill pipe string;

re-running the drill pipe string back into the casing string, and securing the cementing tool to the liner hanger assembly; then pumping cement through the drill pipe string and the cementing tool into the liner string and back up the annulus to cement the liner string in the well.

8. The method according to claim 7, wherein the cementing tool is carrying a cement plug device;

the method further comprising launching the cement plug device from the cementing tool, which latches into the bottom portion of the liner string and prevents backflow of cement from the annulus into the liner.

9. The method according to claim 8, further comprising:

after cementing and before retrieving the drill pipe string and the cementing tool, setting a packer between the upper portion of the liner string and the casing string.

10. The method according to claim 7, wherein steps (b) and (j) comprise rotating the drill pipe string, transferring torque from the drill pipe string to the upper portion of the liner string to cause the liner string to rotate, and transferring torque from the lower portion of the liner string to the bottom hole assembly to rotate the drill bit.

11. A method of installing a liner in a well having at least one casing string, comprising:

(a) making up a liner string with a liner hanger assembly at an upper portion of the liner string and a profile sub at a bottom portion of the liner string;

(b) latching a bottom hole assembly to the profile sub such that the bottom hole assembly protrudes from the liner string, the bottom hole assembly including a drill bit;

(c) attaching a lower end of a drill pipe string to a running tool and the running tool to the liner hanger assembly;

(d) lowering the liner hanger assembly on the drill pipe string until the drill bit reaches a bottom of the well and rotating the drill bit to drill the well deeper;

(e) at a selected depth, conveying a sealing object down the liner string into sealing engagement with the bottom hole assembly, then applying fluid pressure in the drill pipe string and the liner string to release the bottom hole assembly from the profile sub; then (f) causing drilling fluid in an annulus of the liner string to flow downward into the bottom of the liner string and back upward in the liner string to push the bottom hole assembly upward;

(g) when the bottom hole assembly reaches the running tool, latching the bottom hole assembly to the running tool;

(h) moving the liner hanger assembly into setting engagement with the casing string to support the weight of the liner string; and (i) releasing the running tool from the liner hanger assembly and retrieving the drill pipe string along with the bottom hole assembly and the running tool.

12. The method according to claim 11, further comprising:

after step (i), re-running the running tool and the bottom hole assembly back into the casing string with the drill pipe string;

re-securing the running tool to the liner hanger assembly;

releasing the liner hanger assembly from setting engagement with the casing string;

conveying another sealing object down the drill pipe string into engagement with the running tool to release the bottom hole assembly from the running tool;

causing the bottom hole assembly to move down the liner string from the running tool and latch into the profile sub; then rotating the drill bit and continuing to drill the well.

13. The method according to claim 11, further comprising:

after step (i), re-running the running tool and the bottom hole assembly back into the casing string with the drill pipe string;

re-securing the running tool to the liner hanger assembly;

releasing the liner hanger assembly from setting engagement with the casing string; then pumping down the drill pipe a second sealing object into engagement with the running tool to release the bottom hole assembly from the running tool;

applying fluid pressure to the drill pipe to cause the bottom hole assembly to move down the liner string from the running tool and latch into the profile sub; then rotating the drill bit and continuing to drill the well.

14. The method according to claim 11, further comprising:

after step (i), detaching the running tool from the drill pipe string and attaching a cementing tool to the drill pipe string, re-running the drill pipe string back into the casing string, and securing the cementing tool to the liner hanger assembly; then pumping cement through the drill pipe string and the cementing tool into the liner string and back up the annulus to cement the liner string in the well.

15. The method according to claim 11, further comprising:

after step (i), detaching the running tool from the drill pipe string and attaching a cementing tool to the drill pipe string, the cementing tool carrying a cement plug device;

re-running the drill pipe string back into the casing string, and securing the cementing tool to the liner hanger assembly;

pumping cement through the drill pipe string and the cementing tool into the liner string and back up the annulus to cement the liner string in the well; and launching the cement plug device from the cementing tool, which latches into the bottom portion of the liner string and prevents backflow of cement from the annulus into the liner.

16. The method according to claim 15, further comprising:

after cementing and before retrieving the drill pipe string, manipulating the cementing tool to set a packer between the upper portion of the liner string and the casing.

17. The method according to claim 11, wherein step (e) comprises pumping the sealing object down the drill pipe and down the liner string.

18. The method according to claim 11, wherein step (d) comprises rotating the drill pipe string, transferring torque from the drill pipe string to the upper portion of the liner string to cause the liner string to rotate, and transferring torque from the lower portion of the liner string to the bottom hole assembly to rotate the drill bit.

* * * * *